US006930541B2

(12) United States Patent
Chen et al.

(10) Patent No.: US 6,930,541 B2
(45) Date of Patent: Aug. 16, 2005

(54) VOLTAGE CLAMPER CAPABLE OF CONTROLLING A VOLTAGE DROP ACCORDING TO AN EXTERNAL INPUT VOLTAGE

(75) Inventors: Chih-Hung Chen, Hsin-Chu (TW); Yung-Shin Kao, Hsin-Chu (TW)

(73) Assignee: Faraday Technology Corp., Hsin-Chu (TW)

( * ) Notice: Subject to any disclaimer, the term of this patent is extended or adjusted under 35 U.S.C. 154(b) by 0 days.

(21) Appl. No.: 10/708,424

(22) Filed: Mar. 2, 2004

(65) Prior Publication Data

US 2005/0046468 A1 Mar. 3, 2005

(30) Foreign Application Priority Data

Aug. 25, 2003 (TW) ..... 92123322 A

(51) Int. Cl.[7] ..... G05F 1/10

(52) U.S. Cl. ..... 327/541; 327/309

(58) Field of Search ..... 327/308, 309, 327/318, 321, 327, 328, 331, 530, 534, 535, 540, 541

(56) References Cited

U.S. PATENT DOCUMENTS 6,677,801 B2 * 1/2004 Shimomura ..... 327/530

* cited by examiner

*Primary Examiner*—Jeffrey Zweizig
(74) *Attorney, Agent, or Firm*—Winston Hsu

(57) ABSTRACT

A voltage clamper for controlling an input voltage to generate an output voltage is provided. The voltage clamper includes a bias circuit for generating at least a bias voltage according to the input voltage, a voltage drop circuit for applying a voltage drop to the input voltage, and a voltage detection circuit electrically connected to the voltage drop circuit and the bias circuit for generating the output voltage through adjusting the voltage drop generated from the voltage drop circuit according to the bias voltage.

29 Claims, 4 Drawing Sheets

VOLTAGE CLAMPER CAPABLE OF CONTROLLING A VOLTAGE DROP ACCORDING TO AN EXTERNAL INPUT VOLTAGE

BACKGROUND OF INVENTION

1. Field of the Invention

The present invention provides a voltage clamper, and more particularly, to a voltage clamper capable of providing a corresponding voltage drop according to an external input voltage.

2. Description of the Prior Art

With the progressive development of semiconductor processes, many different circuits are integrated into integrated circuits to drive the development of electronic products. For example, one memory chip may comprise a plurality of memory cells for storing data. Owing to the development of semiconductor processes, more memory cells are accommodated in a same area on a memory chip. Typically, the operation voltages of internal devices are limited in a voltage range according to the spec of integrated circuits. For example, the operation voltage of the above-mentioned memory chip must be limited in a voltage range to allow the memory chip to function normally. When the operation voltage supplied to the memory chip is too high, structural damage to the memory cells in the memory chip may cause reliability issues in data storage of memory cells. Oppositely, the operation voltage may not be able to successfully drive the memory cells to store data in a predetermined period of time when the operation voltage supplied to the memory chip is too low. Therefore, the memory chip must operate under a low clock. In other words, an operation voltage that is too low will affect the performance of the memory chip greatly.

Generally speaking, the same memory chip can be applied to different devices and used for storing data temporarily. However, different devices may be supplied with different external voltages. For example, the power supply module of one device provides a voltage level of 3.6V, but the power supply module of another device provides a voltage level of 1.6V. Therefore, the prior art memory chip utilizes a voltage drop circuit to transform the external voltage to the internal operation voltage that is applicable to the memory chip. For example, the voltage drop circuit may generate a fixed voltage drop of 1V. Under the circumstances, the range of the operation voltage of the memory chip to function normally is 2.6V–1.6V, based on the spec of the voltage drop circuit. In other words, the memory chip having such a voltage drop circuit can be only applied to devices supplied with an external voltage ranging from 3.6V to 2.6V. When the memory chip having such a voltage drop circuit is applied to a device supplied with an external voltage of 4V, the operation voltage of the memory chip will exceed the normally functional range of the operation voltage of the memory chip (2.6V–1.6V), since the operation voltage of the memory chip, used for driving the internal memory cells, is 3V after the voltage drop circuit applies a voltage drop of 1V to the external voltage. As a result, reliability issues arise when the memory chip is storing data. Similarly, the operation voltage of the memory chip, used for driving the internal memory cells, is 1V after the voltage drop circuit applies a voltage drop of 1V to the external voltage when the memory chip having such a voltage drop circuit is applied to a device supplied with an external voltage of 2V. Since 1V is not within the normally functional range of the operation voltage of the memory chip (2.6V–1.6V), the performance of the memory chip is greatly affected due to this operation voltage that is too low, as mentioned previously.

Since a fixed voltage drop is generated by the voltage drop circuit utilized in the prior art memory chip, the application range of the memory chip is limited by the fixed voltage drop. As mentioned previously, the memory chip can be only applied to devices supplied with an external voltage ranging from 3.6V to 2.6V because a 1V voltage drop is generated by the voltage drop circuit and the normally functional range of the operation voltage of the memory chip is 2.6V–1.6V. When the memory chip is applied to a device supplied with an external voltage of 4V, the voltage drop circuit on the memory chip needs to be re-designed to lift the voltage drop generated by itself. Similarly, when the memory chip is applied to a device supplied with an external voltage of 2V, the voltage drop circuit on the memory chip also needs to be re-designed to reduce the voltage drop generated by itself. Therefore, the production cost of the memory chip is greatly raised to make the memory chip not competitive.

SUMMARY OF INVENTION

It is therefore a primary objective of the present invention to provide a voltage clamper to determine a corresponding voltage drop according to an external input voltage to resolve the above-mentioned problems.

According to the claimed invention, a voltage clamper for generating an output voltage by adjusting an input voltage age is disclosed. The voltage clamper comprises a bias circuit for generating at least a bias voltage according to the input voltage, a voltage drop circuit for applying a voltage drop to the input voltage, and a voltage detection circuit electrically connected to the voltage drop circuit and the bias circuit for generating the output voltage through adjusting the voltage drop generated from the voltage drop circuit according to the bias voltage.

According to the claimed invention, a voltage adjusting method for generating an output voltage by adjusting an input voltage is disclosed. The voltage adjusting method comprises setting a plurality of voltage segments corresponding to a plurality of different voltage drop setting values, and utilizing one of the voltage drop setting values to trigger a voltage difference between the output voltage and the input voltage corresponding to the voltage drop setting value when the input voltage is within one of the voltage segments.

It is an advantage of the claimed invention that the present invention voltage clamper dynamically determines the voltage drop applied in the voltage drop operation according to the voltage level of the external input voltage, rather than applying a fixed voltage drop. Therefore, the present invention voltage clamper can maintain the output voltage within the corresponding range of the operation voltage of the device utilizing the present invention voltage clamper, no matter if the external input voltage has a high voltage level or a low voltage level. As a result, the phenomena of insufficient voltage drop and over high voltage drop, which usually occur when utilizing the prior art voltage clamper, do not occur when utilizing the present invention voltage clamper.

These and other objectives of the present invention will no doubt become obvious to those of ordinary skill in the art after having read the following detailed description of the preferred embodiment that is illustrated in the various figures and drawings.

DETAILED DESCRIPTION

Figure 1:
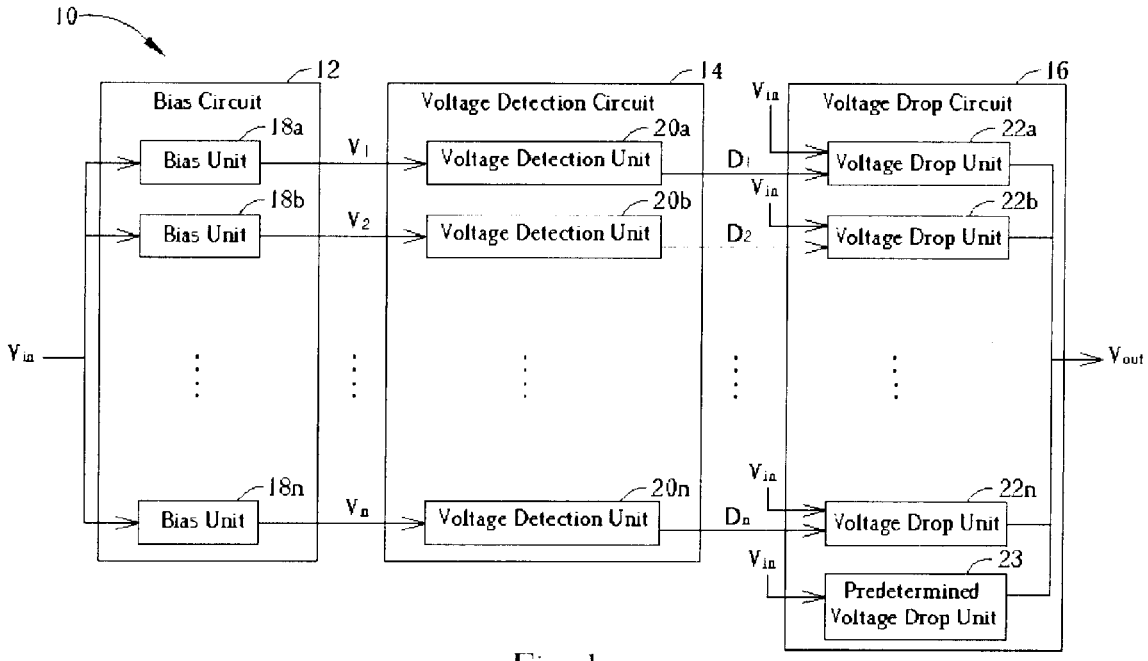
FIG. 1 is a function block diagram of a voltage clamper of the present invention.

Please refer to FIG. 1. FIG. 1 is a function block diagram of a voltage clamper 10 of the present invention. The present invention voltage clamper 10 comprises a bias circuit 12, a voltage detection circuit 14, and a voltage drop circuit 16. The bias circuit 12 is used for generating a bias voltage according to an input voltage $V_{in}$. The voltage detection circuit 14 determines how much voltage drop the voltage drop circuit 16 applies to the input voltage $V_{in}$ according to the bias voltage so as to generate an output voltage $V_{out}$. In this preferred embodiment, a plurality of bias units 18 are installed in the bias circuit 12, a plurality of voltage detection units 20 are installed in the voltage detection circuit 14, and a plurality of voltage drop units 22 and a predetermined voltage drop unit 23 are installed in the voltage drop circuit 16. Without altering the teachings of the invention, only three bias units 18*a*, 18*b*, 18*n*, three voltage detection units 20*a*, 20*b*, 20*n*, and three voltage drop units 22*a*, 22*b*, 22*n* are shown in FIG. 1 for simplicity. When the input voltage $V_{in}$ is input to the bias circuit 12, the bias unit 18*a* will generate a bias voltage $V_1$ according to the input voltage $V_{in}$, the bias unit 18*b* will generate a bias voltage $V_2$ according to the input voltage $V_{in}$, and the bias unit 18*n* will generate a bias voltage $V_n$ according to the input voltage $V_{in}$. The voltage levels of the bias voltages $V_1$, $V_2$, $V_n$ are different from each other. Assume that the bias voltage $V_1$ is greater than the bias voltage $V_2$, and the bias voltage $V_2$ is greater than the bias voltage $V_n$. Although the bias voltages $V_1$, $V_2$, $V_n$ change when the magnitude of the input voltage changes, the relative magnitude relationship of the bias voltages $V_1$, $V_2$, $V_n$ does not change. For example, if the bias voltages $V_1$, $V_2$, $V_n$ are 2V, 1.8V, and 1.5V, respectively, when the input voltage $V_{1n}$ is 5V, the bias voltages $V_1$, $V_2$, $V_n$ are reduced to 1.6V, 1.4V, and 1.2V, respectively, when the input voltage $V_{1n}$ is reduced to 4V. Therefore, the bias voltage $V_1$ is still greater than the bias voltage $V_2$, and the bias voltage $V_2$ is still greater than the bias voltage $V_n$.

The voltage detection unit 20*a* receives the bias voltage $V_1$ to generate a control signal $D_1$ according to the bias voltage $V_1$, the voltage detection unit 20*b* receives the bias voltage $V_2$ to generate a control signal $D_2$ according to the bias voltage $V_2$, and the voltage detection unit 20*n* receives the bias voltage $V_n$ to generate a control signal $D_n$ according to the bias voltage $V_n$. In this preferred embodiment, each voltage detection unit 20*a*, 20*b*, 20*n* in the voltage detection circuit 14 is used for detecting a same predetermined voltage level. That means, each voltage detection unit 20*a*, 20*b*, 20*n* sieves the bias voltages $V_1$, $V_2$, $V_n$ according to the predetermined voltage level and decides whether to output the control signal $D_1$, $D_2$, $D_n$ to activate the voltage drop unit 22*a*, 22*b*, 22*n* or not. Each voltage drop unit 22*a*, 22*b*, 22*n* is used to apply a different voltage drop to the input voltage $V_{in}$ to adjust the voltage level of the output voltage $V_{out}$. For example, the voltage drop unit 22*a* may make the input voltage $V_{in}$ generate a voltage drop of $dV_1$. That means, the output voltage $V_{out}$ will be approximately equal to $V_{in}-dV_1$ when the voltage drop unit 22*a* is activated. Similarly, the voltage drop unit 22*b* may make the input voltage $V_{in}$ generate a voltage drop of $dV_2$. That means, the output voltage $V_{out}$ will be approximately equal to $V_{in}-dV_2$ when the voltage drop unit 22*b* is activated. The voltage drop unit 22*n* may make the input voltage $V_{in}$ generate a voltage drop of $dV_n$. That means, the output voltage $V_{out}$ will be approximately equal to $V_{in}$ $dV_n$ when the voltage drop unit 22*n* is activated. Therefore, the voltage drops between the output voltage $V_{out}$ and the input voltage $V_{in}$ are controlled by the voltage drop units 22*a*, 22*b*, 22*n*. Furthermore, a predetermined voltage drop unit 23 is installed in the voltage drop circuit 16 to apply an initial voltage drop to the input voltage $V_{in}$ to affect the output voltage $V_{out}$ when the voltage age clamper 10 is activated.

Figure 2:
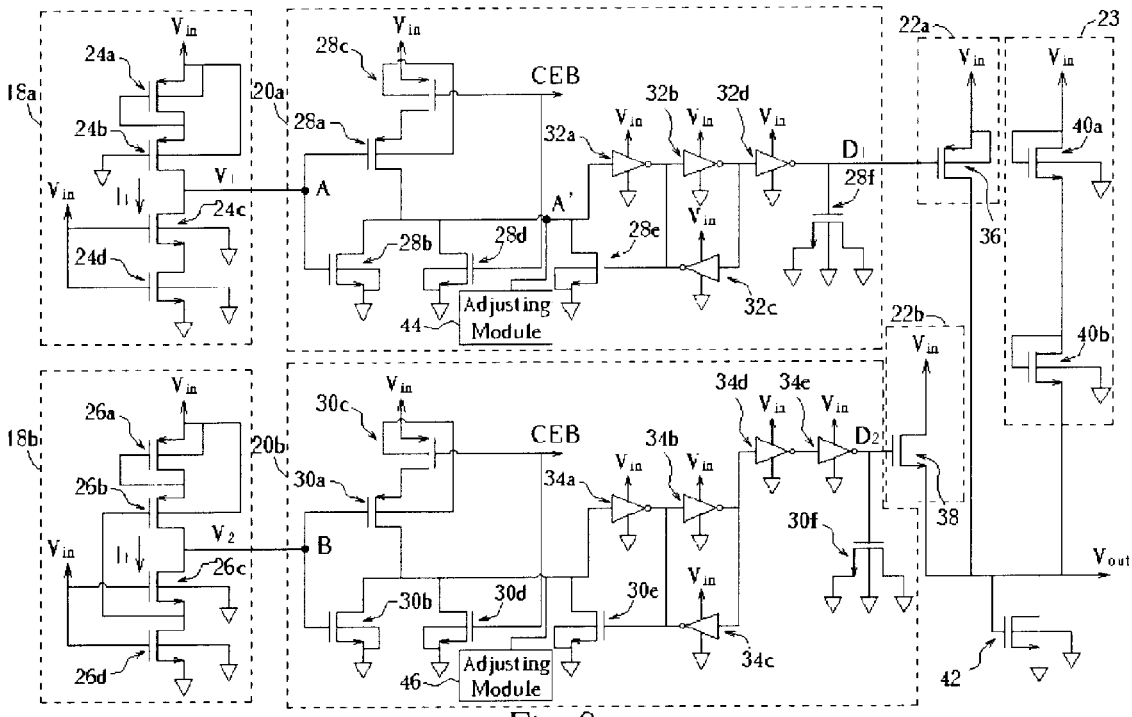
FIG. 2 is a circuit diagram of the voltage clamper shown in FIG. 1.

Please refer to FIG. 2. FIG. 2 is a circuit diagram of the voltage clamper 10 shown in FIG. 1. In order to illustrate more conveniently, only two bias units 18*a*, 18*b*, two voltage detection units 20*a*, 20*b*, two voltage drop units 22*a*, 22*b*, and one predetermined voltage drop unit 23 are shown in the voltage clamper 10 shown in FIG. 2. As shown in FIG. 1, please note that the numbers of the bias units, the voltage detection units, and the voltage drop units are not limited in the present invention voltage clamper 10. In this preferred embodiment, a current $I_1$ flowing through the bias unit 18*a* is different from a current $I_2$ flowing through the bias unit 18*b* under the same input voltage $V_{in}$ by applying different connection structures to transistors 24*a*, 24*b*, 24*c*, 24*d* and transistors 26*a*, 26*b*, 26*c*, 26*d* in the bias units 18*a*, 18*b*. Finally, the bias voltage $V_1$ is controlled to be greater than the bias voltage $V_2$. In addition, the bias units 18*a*, 18*b* may utilize other kind of circuits (such as a voltage dividing circuit comprising only resistors) to achieve the objective that different bias voltages $V_1$, $V_2$ are generated under the same input voltage $V_{in}$. The bias voltage $V_1$ generated by the bias unit 18*a* is input to an input terminal A of the voltage detection unit 20*a*. The voltage detection unit 20*a* thus decides whether to conduct transistors 28*a*, 28*b* or not according to the bias voltage $V_1$. If the bias voltage $V_1$ is greater than a predetermined voltage level, the transistor 28*b* is turned on to drive the control signal $D_1$ to approach a high logic level "1". Oppositely, the transistor 28*a* is turned on and the transistor 28*b* is not turned on to drive the control signal $D_1$ to approach a low logic level "0" if the bias voltage $V_1$ is smaller than the predetermined voltage level. In addition, the bias voltage $V_2$ generated by the bias unit 18*b* is input to an input terminal B of the voltage detection unit 20*b*. Similarly, the voltage detection unit 20*b* thus decides whether to turn on the transistors 30*a*, 30*b* or not according to the bias voltage $V_2$. If the bias voltage $V_2$ is greater than the same predetermined voltage level, the transistor 30*b* is turned on to drive the control signal $D_2$ to approach the low logic level "0". Oppositely, the transistor 30*a* is turned on and the transistor 30*b* is not turned on to drive the control signal $D_2$ to approach the high logic level "1" if the bias voltage $V_2$ is smaller than the same predetermined voltage level.

In the voltage detection unit 20*a*, the operation of inverters 32*a*, 32*b*, 32*c* is similar to that of a prior art Schmitt trigger, and an inverter 32*d* functions as a buffer. In addition, a substrate, a source, and a drain of a transistor 28*f* are connected to ground. Therefore, the transistor 28*f* functions as a capacitor module to stabilize the control signal D1. When the transistor 28*b* is turned on, the loop formed by the inverters 32*b*, 32*c* will maintain an input terminal of the inverter 32*d* at the low logic level "0", and the transistor 28*e* is turned on. When the transistor 28*b* is not turned on, the loop formed by the inverters 32*b*, 32*c* will maintain the input terminal of the inverter 32*d* at the high logic level "1", and the transistor 28*e* is not turned on. For the voltage detection unit 20*b*, the operation of inverters 34*a*, 34*b*, 34*c* is similar to that of the prior art Schmitt trigger, and inverters 34*d*, 34*e* function as buffers. In addition, a substrate, a source, and a drain of a transistor 30*f* are connected to ground. Therefore, the transistor 30*f* functions as a capacitor module to stabilize the control signal $D_2$. When the transistor 30*b* is turned on, the loop formed by the inverters 34*b*, 34*c* will maintain an input terminal of the inverter 34*d* at the low logic level "0", and a transistor 30*e* is turned on. When the transistor 30*b* is not turned on, the loop formed by the inverters 34*b*, 34*c* will maintain the input terminal of the inverter 34*d* at the high logic level "1", and the transistor 30*e* is not turned on.

The voltage drop unit 22*a* comprises a transistor 36, and the voltage drop unit 22*b* comprises a transistor 38. In this preferred embodiment, the transistor 36 is a P-type metal-oxide-semiconductor (PMOS) transistor, and the transistor 38 is an N-type metal-oxide-semiconductor (NMOS) transistor. As well known by those skilled in the art, a P-type metal-oxide-semiconductor transistor is a good switch device, and an N-type metal-oxide-semiconductor transistor is a bad switch device, when transferring a high logic level "1". In other words, the voltage level at a drain of the transistor 36 is approximately equal to that at a source of the transistor 36 (that means the input voltage $V_{in}$) when the transistor 36 is turned on. However, the voltage level at a drain of the transistor 38 is greater than that at a source of the transistor 38 when the transistor 38 is turned on. In other words, the voltage level at the source of the transistor 38 is approximately equal to $V_{in}-V_t$, rather than the input voltage $V_{in}$. It is worth noting that $V_t$ is the threshold voltage corresponding to a channel of the transistor 38. In addition, the predetermined voltage drop unit 23 comprises two transistors 40*a*, 40*b* in this preferred embodiment, and transistors 40*a*, 40*b* are both N-type metal-oxide-semiconductor transistors. As shown in FIG. 2, a drain of the transistor 40*a* is connected to a gate of the transistor 40*a*, and a drain of the transistor 40*b* is connected to a gate of the transistor 40*b*. Therefore, the transistors 40*a*, 40*b* are always turned on and operate within a saturation region. As mentioned previously, an N-type metal-oxide-semiconductor transistor is a bad switch device when transferring a high logic level "1". If the transistors 40*a*, 40*b* have the same threshold voltage $V_t$ as the transistor 38, the voltage level at a source of the transistor 40*b* eventually approaches $V_{in}-2V_t$. In FIG. 2, a transistor 42 utilized in the voltage clamper 10 functions as a capacitor module to stabilize the voltage level of the output voltage $V_{out}$. In this preferred embodiment, a gate and a drain of the transistor are electrically connected to the output voltage $V_{out}$, and a substrate and a source of the transistor 42 are connected to ground. It is very obvious that the transistor 42 will be kept in a conductive state when the voltage clamper 10 is operating. Therefore, the transistor 42 may be regarded as a resistor in parallel with a capacitor. In comparison with the transistors 28*f*, 30*f*, the transistor 42 has a greater RC time constant to maintain the output voltage $V_{out}$ more stably.

Figure 3:
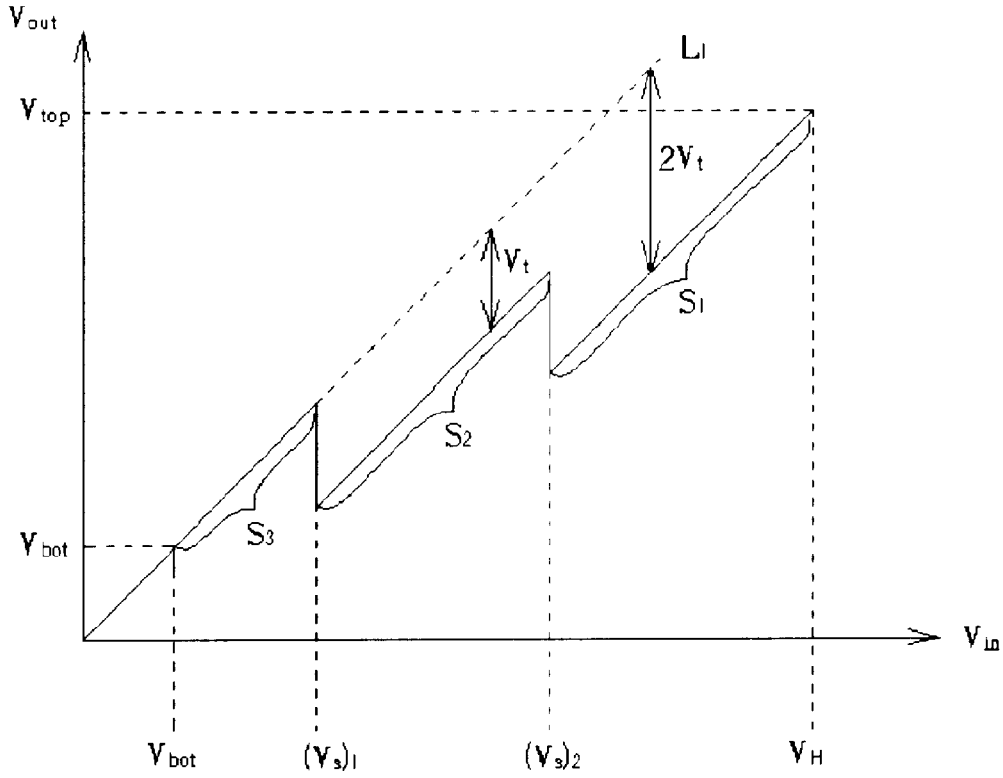
FIG. 3 is a schematic diagram of the output voltage of the voltage clamper shown in FIG. 2.

Please refer to FIG. 2 and FIG. 3. FIG. 3 is a schematic diagram of the output voltage of the voltage clamper 10 shown in FIG. 2. In FIG. 3, the horizontal axis represents the input voltage $V_{in}$, and the vertical axis represents the output voltage $V_{out}$. It is known from the above description that the bias voltage $V_1$ output by the bias unit 18*a* is greater than the bias voltage $V_2$ output by the bias unit 18*b* with the same input voltage $V_{in}$, and the voltage detection units 20*a*, 20*b* detect a predetermined voltage level to decide whether to activate the voltage drop units 22*a*, 22*b* or not. When the input voltage $V_{in}$ is equal to the voltage level of $(V_s)_2$, the bias voltage $V_2$ is equal to the predetermined voltage level. At this time, the bias voltage $V_1$ is greater than the predetermined voltage level since the bias voltage $V_1$ is greater than the bias voltage $V_2$. In other words, the transistor 30*b* in the voltage detection unit 20*b* will keep conducting until the bias voltage $V_2$ starts to be smaller than the predetermined voltage level. The control signal $D_2$ is thus at the high logic level "1" to activate the corresponding voltage drop unit 22*b*. When the input voltage $V_{in}$ is equal to the voltage level of $(V_s)_1$, the bias voltage $V_1$ is equal to the predetermined voltage level. At this time, the bias voltage $V_2$ is smaller than the predetermined voltage level since the bias voltage $V_2$ is smaller than the bias voltage $V_1$. In other words, the transistor 28*b* in the voltage detection unit 20*a* will keep conducting until the bias voltage $V_1$ starts to be smaller than the predetermined voltage level. The control signal $D_1$ is thus at the low logic level "0" to activate the corresponding voltage drop unit 22*a*. It is worth noting that the transistor 30*b* in the voltage detection unit 20*b* will be kept in a non-conductive state since the bias voltage $V_2$ is smaller than the predetermined voltage. The control signal $D_2$ is thus kept at the high logic level "1". As a result, the corresponding voltage drop unit 22*b* is kept in an active state.

As shown in FIG. 3, an oblique line $L_1$ represents that the output voltage $V_{out}$ is equal to the input voltage $V_{in}$. When the input voltage $V_{in}$ is greater than the voltage level of $(V_s)_2$, the bias voltages $V_1$, $V_2$ corresponding to the input voltage $V_{in}$ are both greater than the above-mentioned predetermined voltage level. At this time, only the predetermined voltage drop unit 23 will affect the output voltage $V_{out}$. That means, the voltage difference between the output voltage $V_{out}$ and the input voltage $V_{in}$ corresponds to the voltage difference applied by the transistors 40*a*, 40*b*($2*V_t$), when the input voltage $V_{in}$ is greater than the voltage level of $(V_s)_2$, and the relationship between the output voltage $V_{out}$ and the input voltage $V_{in}$ is shown in segment S1. When the input voltage $V_{in}$ is smaller than the voltage level of $(V_s)_2$ and is greater than the voltage level of $(V_s)_1$, the bias voltage $V_2$ corresponding to the input voltage $V_{in}$ is smaller than the predetermined voltage level, and the bias voltage $V_1$ corresponding to the input voltage $V_{in}$ is still greater than the predetermined voltage level, as mentioned previously. At this time, both the voltage drop unit 22*b* and the predetermined voltage drop unit 23 are activated. It is worth noting that the predetermined voltage drop unit 23 will apply a voltage difference of 2*Vt to the input voltage $V_{in}$, and the voltage drop unit 22*b* will only apply a voltage difference of $V_t$ to the input voltage $V_{in}$. Since the transistor 42 is used as a capacitor module, the voltage drop unit 22*b* will charge the transistor 42 and trigger the voltage difference between the output voltage $V_{out}$ and the input voltage $V_{in}$ corresponding to the voltage difference applied by the transistor 38($V_t$), and the relationship between the output voltage $V_{out}$ and the input voltage $V_{in}$ is shown in segment S2. When the input voltage $V_{in}$ is smaller than the voltage level of $(V_s)_1$, the bias voltages $V_1$, $V_2$ corresponding to the input voltage $V_{in}$ are both smaller than the predetermined voltage level, as mentioned previously. At this time, the voltage drop units 22*a*, 22*b* and the predetermined voltage drop unit 23 are all activated. It is worth noting that the predetermined voltage drop unit 23 will apply a voltage difference of $2*V_t$ to the input voltage $V_{in}$, and the voltage drop unit 22*b* will apply a voltage difference of $V_t$ to the input voltage $V_{in}$, and the voltage drop unit 22*a* will not apply any voltage difference to the input voltage $V_{in}$. That means, the voltage drop unit 22*a* transfers the input voltage $V_{in}$ to trigger the output voltage $V_{out}$. Since the transistor 42 is used as a capacitor module, the voltage drop unit 22*a* will charge the transistor 42 to trigger the output voltage $V_{out}$ to be approximately equal to the input voltage $V_{in}$. The relationship between the output voltage $V_{out}$ and the input voltage $V_{in}$ is shown in segment S3.

It is worth noting that gates of the transistors 28*c*, 28*d* of the voltage detection unit 20*a* are all triggered by a control signal CEB in the voltage clamper 10 in FIG. 2. Similarly, gates of the transistors 30*c*, 30*d* of the voltage detection unit 20*b* are all triggered by the same control signal CEB. The present invention voltage clamper 10 supports chip enable control to achieve the objective of low current consumption. The voltage clamper 10 can switch to a standby mode or a normal mode according to the external control signal CEB. For example, the voltage clamper 10 will enter the standby mode when the control signal CEB is at the high voltage level. At this time, the transistors 28*c*, 30*c* are not turned on, and the control signal CEB will turn on the transistors 28*d*, 30*d*. In other words, only the predetermined voltage drop unit 23 is activated when the voltage clamper 10 enters the standby mode, and the voltage drop units 22*a*, 22*b* cannot be turned on to adjust the output voltage $V_{out}$. Therefore, a greater voltage difference (that is $2*V_t$) exists between the output voltage $V_{out}$ and the input voltage $V_{in}$. For a device utilizing the voltage clamper 10, the device will output the control signal CEB to the voltage clamper 10 when entering the standby mode. Since the output voltage $V_{out}$ of the voltage clamper 10 in the standby mode is lower, the current consumed by the device in the standby mode is smaller to reduce power consumption. Oppositely, the control signal CEB will be at the low voltage level to trigger the voltage clamper 10 to enter the normal mode when the device wants to exit the standby mode and enter the normal mode. As shown in FIG. 2, the transistors 28*c*, 30*c* are thus turned on to transfer the input voltage $V_{in}$ to the transistors 28*a*, 30*a*. In addition, the transistors 28*d*, 30*d* will be kept in a non-conductive state. Therefore, the activation of the voltage drop units 22*a*, 22*b* are controlled by the bias voltages $V_1$, $V_2$. That means, the relationship between the input voltage $V_{in}$ and the output voltage $V_{out}$ is shown as FIG. 3.

If the present invention voltage clamper 10 is applied to a memory chip, and the normally functional range of the operation voltage of the memory chip is between the voltage level of $V_{top}$ and the voltage level of $V_{bot}$, the memory chip can operate smoothly when the input voltage $V_{in}$ is between the voltage level of $V_{top}$ and the voltage level of $V_{H(}V_H>V_{bot})$, as shown from the relationship between the output voltage $V_{out}$ and the input voltage $V_{in}$ in FIG. 3. Therefore, the greater the input voltage $V_{in}$ is, the greater voltage drop between the input voltage $V_{in}$ and the output voltage $V_{out}$ is triggered by the voltage clamper 10. Oppositely, the smaller the input voltage $V_{in}$ is, the smaller voltage drop between the input voltage $V_{in}$ and the output voltage $V_{out}$ is triggered by the voltage clamper 10. For example, the normally functional range of the operation voltage of the memory chip is 2.6V–1.6V. When the power supply module of a device supplies a high driving voltage of $(2.6+2*V_t)$, the voltage clamper 10 will help to transform the input voltage $(2.6+2*V_t)$ into an output voltage of 2.6V and transfer the output voltage (2.6V) to the memory chip to trigger the memory chip. The memory chip thus operates smoothly under such a high driving voltage. However, when the power supply module of a device supplies a low driving voltage of 1.6V, the voltage clamper 10 will not adjust the output voltage. That means, the output voltage is equal to the input voltage 1.6V, and the voltage clamper 10 will transfer the output voltage (1.6V) to the memory chip to trigger the memory chip. As a result, the memory chip can function normally under a low external voltage.

Figure 4:
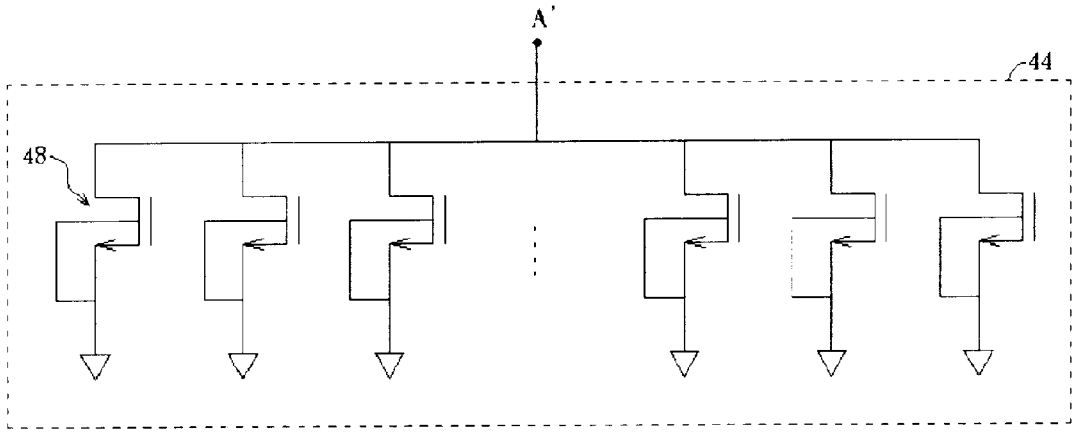
FIG. 4 is a circuit diagram of the adjusting module shown in FIG. 2.

When the driving voltage supplied by the power supply module in a device is between the voltage level of $V_H$ and the voltage level of $(V_s)_2$, the memory chip utilizing the voltage damper 10 can function normally in the device. Similarly, the memory chip utilizing the voltage damper 10 can function normally in the device when the driving voltage supplied by the power supply module is between the voltage level of $(V_s)_1$ and the voltage level of $(V_s)_2$, and between the voltage level of $V_{bot}$ and the voltage level of $(V_s)_1$. However, there is a problem when the driving voltage supplied by the power supply module approaches $(V_s)_1$ or $(V_s)_2$. It is known that the predetermined voltage level originally set by the voltage detection units 20*a*, 20*b* will control the voltage damper 10 to trigger the output voltage $V_{out}$ to generate changes of the voltage levels, when the voltage levels of $V_{out}$ the input voltage $V_{in}$ are $(V_S)_1$ and $(V_S)_2$. In other words, the output voltage $V_{out}$ will hop between two voltage levels if vibration of the driving voltage supplied by the power supply module occurs in the neighborhood of the voltage level of $(V_s)_1$ or $(V_s)_2$. As a result, the memory chip generates unexpected errors. In order to resolve the problem, the voltage detection unit 20*a* further comprises an adjusting module 44 and the voltage detection unit 20*b* further comprises an adjusting module 46. The adjusting modules 44, 46 are used for adjusting the predetermined voltage levels detected by the voltage detection units 20*a*, 20*b*. Please refer to FIG. 4. FIG. 4 is a circuit diagram of the adjusting module shown in FIG. 2. It is worth noting that only the adjusting module 44 is illustrated because the configuration and the operation of the adjusting module 44 and the adjusting module 46 are the same. The adjusting module 44 comprises a plurality of transistors 48. A drain of each of the transistors 48 is connected to a node A' of the voltage detection unit 20*a*, and a gate of each of the transistor 48 is selectively connected to a source of the transistor or an input terminal A of the voltage detection unit 20*a*. When the gate of the transistor 48 is connected to the input terminal A of the voltage detection unit 20*a*, the transistor 48 is regarded as being in parallel with the transistor 28*b*. Therefore, the transistor 48 can be utilized to adjust the predetermined voltage level at the input terminal A detected by the voltage detection unit 20*a*. Oppositely, the transistor 48 cannot be turned on and will not affect the operation of the voltage detection unit 20*a* when the gate of the transistor is connected to the source of the transistor. In this preferred embodiment, the gate of each of the transistor 48 is connected to the node A' or the source of the transistor is programmed by an upper level metal layer. That means the metal layer is utilized to program the adjusting module 44. For example, the initial setting of the adjustment module 44 is achieved by programming the upper level metal layer through a mask pattern design during the semiconductor processes for forming the voltage damper 10, and the initial setting of the adjusting module 44 is that the gates of half of the transistors 48 are connected to the input terminal A and the gates of half of the transistors 48 are connected to the sources of the corresponding transistors 48. At this time, the characteristic of the input voltage $V_{in}$ and the output voltage $V_{out}$ of the voltage damper 10 is shown in FIG. 3. If it is known that the driving voltage supplied by the power supply module in a device approaches the voltage level of $(V_s)_t$, another mask pattern design is utilized during the semiconductor processes for forming the voltage damper 10. The numbers of the transistors 48 having the gates connected to the sources of the transistors 48 and the numbers of the transistors 48 having the gates connected to the input terminal A are thus adjusted to bias the voltage level of $(V_s)_1$. In addition, the adjust module 44 can lower the voltage level of $(V_s)_1$ or lift the voltage level of $(V_s)_1$. Therefore, the problem that the output voltage $V_{out}$ probably changes greatly due to the input voltage $V_{in}$ approaching the original voltage level of $(V_s)_1$ is avoided. Since the operation of the adjusting module 46 is the same as that of the adjusting module 44, the adjust module 46 can lower the voltage level of $(V_s)_2$ or lift the voltage level of $(V_s)_2$ in this preferred embodiment. As a result, the problem that the output voltage $V_{out}$ probably changes greatly due to the input voltage approaching the original voltage level of $(V_s)_2$ is avoided. In summary, the devices having the voltage damper 10 can operate more stably by utilizing the adjusting modules 44, 46.

As mentioned previously, the operation of the voltage clamper 10 is to set the voltage detection units 20*a*, 20*b*, 20*n* to detect the same predetermined voltage level, and each of the bias unit 18*a*, 18*b*, 18*n* generates each of the different bias voltages $V_1$, $V_2$, $V_n$ according to the input voltage $V_{in}$. Therefore, the magnitude of the input voltage $V_{in}$ is determined according to the bias voltages $V_1$, $V_2$ , $V_n$ and the predetermined voltage level to control the activation of the voltage drop units 22*a*, 22*b*, 22*n*. As a result, the voltage drop between the input voltage $V_{in}$ and the output voltage $V_{out}$ is adjusted. However, the objective of dynamically determining the voltage drop applied in the voltage drop operation according to the voltage level of the input voltage can be achieved by setting the voltage detection units 20*a*, 20*b*, 20*n* to detect different predetermined voltage levels and each of the bias units 18*a*, 18*b*, 18*n* to generate a same bias voltage according to the input voltage $V_{in}$. For example, each of the bias units 18*a*, 18*b* is set to generate a same bias voltage $V_b$ according to the input voltage $V_{in}$. That means, the high input voltage $V_{in}$ is transformed into the low bias voltage $V_b$. In addition, each of the voltage detection units 20*a*, 20*b* is set to detect different predetermined voltage levels of $V_{d1}$, $V_{d2}$, and the predetermined voltage level of $V_{d1}$ is smaller than the predetermined voltage level of $V_{d2}$. It is very obvious that the greater the input voltage $V_{in}$ is, the greater the bias voltage $V_b$ is. Oppositely, the smaller the input voltage $V_{in}$ is, the smaller the bias voltage $V_b$ is. Therefore, the bias voltage $V_b$ can be used to represent the magnitude of the input voltage $V_{in}$. When the bias voltage $V_b$ is greater than the predetermined voltage level of $V_{d2}$, only the predetermined voltage drop unit 23 is activated. When the bias voltage $V_b$ is between the predetermined voltage level of $V_{d1}$ and the predetermined voltage level of $V_{d2}$, both the predetermined voltage drop unit 23 and the voltage drop unit 22*b* are activated. When the bias voltage $V_b$ is smaller than the predetermined voltage level of $V_{d1}$, the predetermined voltage drop unit 23 and the voltage drop units 22*a*, 22*b* are activated. Consequently, the above-mentioned relationship between the input voltage $V_{in}$ and the output voltage $V_{out}$ is shown in FIG. 3. Therefore, the bias circuit 12 and the voltage detection circuit 14 may be set in such a manner as to trigger the voltage drop circuit 16, according to the voltage level of the input voltage $V_{in}$, so that the voltage difference between the output voltage $V_{out}$ and the input voltage $V_{in}$ corresponds to different voltage drops according to different voltage levels of the input voltage $V_{in}$.

Compared to the prior art voltage clamper, the present invention voltage clamper utilizes the bias circuit and the voltage detection circuit to judge the voltage level of the now applied external input voltage, and determine the corresponding voltage difference between the output voltage and the input voltage according to the voltage level. According to the present invention voltage clamper, a plurality of voltage segments are set and each of the voltage segments corresponds to a specific voltage drop to adjust the output voltage. A greater voltage drop is applied to the input voltage corresponding to the voltage segment having a higher voltage level to generate the expected output voltage. Oppositely, a smaller voltage drop is applied to the input voltage corresponding to the voltage segment having a lower voltage level to generate the expected output voltage. In other words, the present invention voltage clamper will apply a greater voltage drop, according to the input voltage, to greatly reduce the output voltage when the input voltage has a high voltage level. Therefore, the problem that one device (such as a memory chip), triggered by the output voltage generated by the voltage clamper according to the external input voltage, cannot function normally owing to the output voltage exceeding the normally functional range of the operation voltage of the device is avoided. In addition, the present invention voltage clamper will not perform the voltage drop operation when the input voltage has a low voltage level. Therefore, the performance of one device (such as a memory chip), triggered by the output voltage generated by the voltage clamper according to the external input voltage, is not greatly affected due to the output voltage being smaller than the normally functional range of the operation voltage of the device. In summary, the present invention voltage clamper dynamically determines the voltage drop applied in the voltage drop operation according to the voltage level of the external input voltage, rather than applying a fixed voltage drop. The present invention voltage clamper thus can maintain the output voltage within the range of the operation voltage of the device utilizing the present invention voltage clamper, no matter if the external input voltage has a high voltage level or a low voltage level. As a result, the phenomena of an insufficient voltage drop and an overly high voltage drop, which usually occur when utilizing the prior art voltage clamper, do not occur when utilizing the present invention voltage clamper.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A voltage clamper for adjusting an input voltage to generate an output voltage, the voltage clamper comprising:

a bias circuit for generating at least one bias voltage according to the input voltage;

a voltage drop circuit for controlling the input voltage to generate a voltage drop, the voltage drop circuit comprising:

a predetermined voltage drop unit electrically connected to an output terminal of the voltage clamper and the input voltage for applying a predetermined voltage drop to the input voltage to adjust the output voltage; and a first voltage drop unit electrically connected to the output terminal of the voltage clamper and the input voltage for applying a first voltage drop to the input voltage to adjust the output voltage;

wherein the predetermined voltage drop unit is always activated, and the activation of the first voltage drop unit is controlled by a voltage detection circuit and the voltage detection circuit electrically connected to the voltage drop circuit and the bias circuit for adjusting the voltage drop generated from the voltage drop circuit according to the bias voltage to generate the output voltage.

2. The voltage clamper of claim 1 wherein the voltage detection circuit comprises:

a first voltage detection unit electrically connected to the first voltage drop unit for controlling the first voltage drop unit to adjust the output voltage.

3. The voltage clamper of claim 2 wherein the bias circuit comprises:

a first bias unit electrically connected to the first voltage detection unit for generating a first bias voltage according to the input voltage and for providing the first bias voltage to the first voltage detection unit;

wherein the first voltage detection unit controls the first voltage drop unit to adjust the output voltage according to the first bias voltage and a first predetermined voltage level.

4. The voltage clamper of claim 3 wherein the first voltage detection unit triggers the first voltage drop unit to adjust the output voltage when the first bias voltage is smaller than the first predetermined voltage level.

5. The voltage clamper of claim 3 wherein the voltage drop circuit further comprises:

a second voltage drop unit electrically connected to the output terminal of the voltage clamper and the input voltage for triggering the output voltage to be approximately equal to the input voltage;

wherein the activation of the second voltage drop unit is controlled by the voltage detection circuit.

6. The voltage clamper of claim 5 wherein the voltage detection circuit further comprises:

a second voltage detection unit electrically connected to the second voltage drop unit for controlling the second voltage drop unit to adjust the output voltage.

7. The voltage clamper of claim 6 wherein the bias circuit further comprises:

a second bias unit electrically connected to the second voltage detection unit for generating a second bias voltage according to the input voltage and for providing the second bias voltage to the second voltage detection unit;

wherein the second voltage detection unit controls the second voltage drop unit to adjust the output voltage according to the second bias voltage and a second predetermined voltage level.

8. The voltage clamper of claim 7 wherein the second voltage detection unit triggers the second voltage drop unit to adjust the output voltage when the second bias voltage is smaller than the second predetermined voltage level.

9. The voltage clamper of claim 7 wherein the first voltage detection unit comprises a first adjusting module for setting the first predetermined voltage level, and the second voltage detection unit comprises a second adjusting module for setting the second predetermined voltage level.

10. The voltage clamper of claim 7 wherein the first bias voltage is equal to the second bias voltage.

11. The voltage clamper of claim 7 wherein the first predetermined voltage level is equal to the second predetermined voltage level.

12. The voltage clamper of claim 2 wherein the first voltage drop is smaller than the predetermined voltage drop.

13. The voltage clamper of claim 2 further comprising a capacitor module electrically connected to the output terminal of the voltage clamp.

14. The voltage clamper of claim 13 wherein the capacitor module comprises an N-type metal-oxide-semiconductor transistor, a gate and a drain of the N-type metal-oxide-semiconductor transistor are electrically connected to the output terminal of the voltage clamper, and a source of the N-type metal-oxide-semiconductor transistor is electrically connected to a ground voltage.

15. A voltage adjusting method for generating an output voltage by adjusting an input voltage comprising:

(a) setting a plurality of voltage segments corresponding to a plurality of different voltage drop setting values and setting the voltage drop setting value of a first voltage segment to be greater than the voltage drop setting value of a second voltage segment, wherein a minimum voltage of the first voltage segment is greater than a maximum voltage of the second voltage segment; and (b) utilizing one of the voltage drop setting values to trigger a voltage difference between the output voltage and the input voltage corresponding to the voltage drop setting value when the input voltage is within one of the voltage segments.

16. A voltage clamper for adjusting an input voltage to generate an output voltage, the voltage clamper comprising:

a bias circuit for generating at least one bias voltage according to the input voltage;

a voltage drop circuit for controlling the input voltage to generate a voltage drop, the voltage drop circuit comprising:

a first voltage drop unit electrically connected to the output terminal of the voltage clamper and the input voltage for applying a first voltage drop to the input voltage to adjust the output voltage;

a second voltage drop unit electrically connected to the output terminal of the voltage clamper and the input voltage for applying a second voltage drop to the input voltage to adjust the output voltage;

wherein the activation of the first and second voltage drop units is controlled by a voltage detection circuit; and the voltage detection circuit electrically connected to the voltage drop circuit and the bias circuit for adjusting the voltage drop generated from the voltage drop circuit according to the bias voltage to generate the output voltage.

17. The voltage clamper of claim 16 wherein the voltage drop circuit further comprises:

a predetermined voltage drop unit electrically connected to an output terminal of the voltage clamper and the input voltage for applying a predetermined voltage drop to the input voltage to adjust the output voltage;

wherein the predetermined voltage drop unit is always activated, and the activation of the first and second voltage drop units is controlled by the voltage detection circuit.

18. The voltage clamper of claim 17 wherein the voltage detection circuit comprises:

a first voltage detection unit electrically connected to the first voltage drop unit for controlling the first voltage drop unit to adjust the output voltage.

19. The voltage clamper of claim 18 wherein the bias circuit comprises:

a first bias unit electrically connected to the first voltage detection unit for generating a first bias voltage according to the input voltage and for providing the first bias voltage to the first voltage detection unit;

wherein the first voltage detection unit controls the first voltage drop unit to adjust the output voltage according to the first bias voltage and a first predetermined voltage level.

20. The voltage clamper of claim 19 wherein the first voltage detection unit triggers the first voltage drop unit to adjust the output voltage when the first bias voltage is smaller than the first predetermined voltage level.

21. The voltage clamper of claim 19 wherein the voltage detection circuit further comprises:

a second voltage detection unit electrically connected to the second voltage drop unit for controlling the second voltage drop unit to adjust the output voltage.

22. The voltage clamper of claim 21 wherein the bias circuit further comprises:

a second bias unit electrically connected to the second voltage detection unit for generating a second bias voltage according to the input voltage and for providing the second bias voltage to the second voltage detection unit;

wherein the second voltage detection unit controls the second voltage drop unit to adjust the output voltage according to the second bias voltage and a second predetermined voltage level.

23. The voltage clamper of claim 22 wherein the second voltage detection unit triggers the second voltage drop unit to adjust the output voltage when the second bias voltage is smaller than the second predetermined voltage level.

24. The voltage clamper of claim 22 wherein the first voltage detection unit comprises a first adjusting module for setting the first predetermined voltage level, and the second voltage detection unit comprises a second adjusting module for setting the second predetermined voltage level.

25. The voltage clamper of claim 22 wherein the first bias voltage is equal to the second bias voltage.

26. The voltage clamper of claim 22 wherein the first predetermined voltage level is equal to the second predetermined voltage level.

27. The voltage clamper of claim 17 wherein the first voltage drop is smaller than the predetermined voltage drop.

28. The voltage clamper of claim 17 further comprising a capacitor module electrically connected to the output of the voltage clamp.

29. The voltage clamper of claim 28 wherein the capacitor module comprises an N-type metal-oxide-semiconductor transistor, a gate and a drain of the N-type metal-oxide-semiconductor transistor are electrically connected to the output terminal of the voltage clamper, and a source of the N-type metal-oxide-semiconductor transistor is electrically connected to a ground voltage.

* * * * *